US006238446B1

(12) United States Patent
Henderson

(10) Patent No.: US 6,238,446 B1
(45) **Date of Patent: *May 29, 2001**

(54) UNLEADED AVIATION GASOLINE

(75) Inventor: Douglas H. Henderson, Glen Allen, VA (US)

(73) Assignee: Ethyl Petroleum Additives, Inc., Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/149,042

(22) Filed: Nov. 8, 1993

Related U.S. Application Data

(63) Continuation-in-part of application No. 08/011,262, filed on Jan. 29, 1993, now abandoned, which is a continuation-in-part of application No. 07/783,210, filed on Oct. 28, 1991, now abandoned.

(51) Int. Cl.[7] ..... C10L 1/18
(52) U.S. Cl. ..... 44/359; 44/449
(58) Field of Search ..... 44/359, 449

(56) References Cited

U.S. PATENT DOCUMENTS 2,391,084 * 12/1945 Carmody ..... 44/449
2,409,746 * 10/1946 Evans et al. ..... 44/449
3,127,351 * 3/1964 Brown et al. ..... 44/359
3,197,414 * 7/1965 Wood ..... 44/359
3,272,606 * 9/1966 Brown et al. ..... 44/359
3,755,195 * 8/1973 Hnizda ..... 44/359
3,788,286 * 1/1974 Brewer ..... 123/43 C
4,141,693 * 2/1979 Feldman et al. ..... 44/359
4,182,913 * 1/1980 Takezono et al. ..... 44/449
4,252,541 * 2/1981 Herbstman ..... 44/449
4,528,411 * 7/1985 Hutson, Jr. ..... 585/329
5,210,326 * 5/1993 Marquez et al. ..... 44/449
5,243,090 * 9/1993 Haag et al. ..... 568/697

OTHER PUBLICATIONS

ASTM Specifications D910–90, "Standard Specification for Aviation Gasoline," pp. 283–289.*

* cited by examiner

*Primary Examiner*—Jerry D. Johnson
(74) *Attorney, Agent, or Firm*—Dennis H. Rainear; Thomas Hamilton; James T. Moore

(57) ABSTRACT

Unleaded aviation gasolines having heats of combustion and octane qualities deemed necessary for use under actual service conditions are formed from blends of specified proportions of aviation alkylate, ether blending agent, a cyclopentadienyl manganese tricarbonyl and optionally other appropriate hydrocarbons falling in the gasoline boiling range.

19 Claims, No Drawings

UNLEADED AVIATION GASOLINE

This is a continuation-in-part of prior application Ser. No. 08/011,262, filed Jan. 29, 1993, now abandoned which in turn is a continuation-in-part of prior application Ser. No. 07/783,210, filed Oct. 28, 1991, now abandoned.

This invention relates to unleaded aviation gasoline compositions. More particularly, this invention provides unleaded high octane aviation gasoline compositions which can achieve performance levels comparable to, if not better than, present-day aviation gasolines. Additionally, this invention accomplishes this important advantage on an economical basis, while at the same time conserving world-wide petroleum resources.

While leaded aviation gasolines have performed wonderfully well in actual service for many years, pressures are being applied to eliminate use of leaded aviation gasoline. If these efforts succeed, the refining industry will be faced with the problem of trying to provide unleaded aviation gasoline that performs as well as leaded aviation gasoline and that does not exceed the economic constraints of the marketplace. In fact, a scientific debate exists as whether it is even possible to produce an unleaded aviation gasoline comparable to the so-called 100/130 low-lead aviation gasoline now in widespread use in the United States. While petroleum refiners generally believe this to be possible, they also believe that the fuel will be very expensive.

When attempting to eliminate use of alkyllead antiknock compounds in aviation gasoline base fuels, it is essential to provide aviation fuel compositions which not only have the requisite octane quality but additionally have the requisite heat of combustion, as this is a measure of the distance an aircraft can fly before refueling. Accordingly, this invention has as its principal object the provision of particular aviation fuel compositions that possess both the necessary octane quality for aviation service and the necessary heat of combustion for aviation service. Another object is to keep the metal content of the fuel composition as low as is consistent with achieving the foregoing objectives.

This invention involves, inter alia, the discovery that it is possible to provide aviation fuels having the necessary heat content (normally expressed in terms of BTU per pound of fuel) and octane quality, by use in forming the fuel of appropriate proportions of aviation alkylate, a gasoline-soluble dialkyl ether octaneblending agent and a cyclopentadienyl manganese tricarbonyl compound. In some cases, it is desirable to also include other suitable gasoline hydrocarbon components in the finished aviation fuel composition, such as isopentane, suitable aromatic gasoline hydrocarbons, light hydrocracked gasoline fractions, and/or $C_{5-6}$ gasoline isomerate in order to ensure that the composition possesses the requisite combination of properties. It will be appreciated therefore that the present invention is an economical way of providing unleaded aviation gasolines having the requisite octane quality and heat of combustion to satisfy aviation engine requirements.

In accordance with this invention, there is provided an unleaded aviation gasoline composition which comprises:

(a) from 85 to 92 volume percent of aviation alkylate;

(b) from 4 to 10 volume percent (preferably about 4 to about 8 volume percent), of at least one ether selected from methyl tertiary-butyl ether, ethyl tertiary-butyl ether, methyl tertiary-amyl ether, and mixtures of any two or all three of the foregoing ethers;

(c) from zero to 10 volume percent of one or more other hydrocarbons falling in the aviation gasoline boiling range; and (d) from 0.25 to 0.6 gram, more preferably, in the range of about 0.4 to about 0.6 gram, and most preferably in the range of about 0.4 to about 0.5 gram, of manganese per gallon as one or more cyclopentadienyl manganese tricarbonyl compounds;

wherein the sum of the amounts of (a) and (b), and also of (c) if present, is 100 volume percent; with the proviso that and that (a), (b) and (d), and also (c) if present, are proportioned such that said composition has (i) an ASTM D 2382 heat of combustion of at least 18,000 BTU per pound (and preferably is at least 18,700 BTU per pound), and (ii) a minimum knock value lean rating octane number of 100 as determined by ASTM Test Method D 2700 and wherein motor method octane ratings are converted to aviation ratings in the manner described in ASTM Specification D 910-90. An ASTM D 2382 heat of combustion value of at least 18,000 BTU per pound is deemed sufficient to provide the range of flight required in actual aircraft service. The preferred minimum value of 18,700 BTU per pound corresponds to the requirement of the present ASTM Specification D 910-90.

A preferred embodiment of this invention is an aviation gasoline composition as above described further characterized by having a minimum supercharged knock value octane number of 130. In other words, the gasoline composition additionally has a minimum performance number reported to the nearest whole number and as determined by ASTM Test Method D 909 of 130. In this connection, a minimum performance number of 130 is equivalent to a knock value determined using isooctane plus 1.28 milliliters of tetraethyllead per gallon.

In particularly preferred embodiments, the aviation alkylate is formed by acid-catalyzed isoparaffin-olefin alkylation wherein the butene fraction of a mixed olefin feedstock is isobutene depleted—i.e., the butene fraction contains, if any, less than 30 percent of isobutene, especially when a hydrofluoric acid alkylation catalyst system is used. Preferably, less than 20% of the butene fraction of the mixed olefin feedstock to the hydrofluoric acid-catalyzed alkylation process is isobutene. Another suitable approach is to use substantially pure isobutene as the olefin feedstock in the hydrofluoric acid-catalyzed alkylation process. Alternatively, the aviation alkylate can be produced by sulfuric acid-catalyzed isoparaffin-olefin alkylation. The aviation alkylates produced in these processes typically are highly branched paraffin hydrocarbons (chiefly in the $C_7$ to $C_9$ range) that distill at temperatures in the range of up to 200° C. and have clear octane ratings in the range of 92–96. Alkylation processes for producing aviation alkylate are known in the art of gasoline manufacture and are referred to for example in W. L. Lafferty and R. W. Stokeld, *Adv. Chem. Ser.,* 103, 130 (1971); D. Putney, *Advances in Petroleum Chemistry and Refining,* Vol. 2., Interscience Publishers, a division of John Wiley & Sons, Inc., New York, 1959, Chapter 5; R. Dixon and J. Allen, Ibid, Volume 3, Chapter 6; and R. H. Rosenwald, *Encyclopedia of Chemical Technology,* Wiley-Interscience, Third Edition, Volume 2, 1978, pages 52–58. Each of these references is incorporated herein by reference.

In general there are two ways of producing for use in aviation alkylate manufacture, a mixed olefin feedstock depleted in isobutene. One is to remove isobutene from the feedstock by physical separation procedures, such as distillation. The other involves recourse to chemical separation such as by charging the feedstock to a reactor in which the isobutene is selectively reacted with a lower alcohol such as methanol or ethanol to produce methyl tertiary-butyl ether or ethyl tertiary-butyl ether. The remainder of the feedstock from which isobutene has been removed is recovered for use in producing the aviation alkylate. For further details concerning the processing useful in selectively reacting isobutene with a lower alcohol to form the ether, reference may be had, for example, to U.S. Pat. Nos. 4,528,411; 5,243,090; 5,024,679 and E.P. 390,596 A2, each of which is incorporated herein by reference.

As noted above one or more other hydrocarbons falling in the aviation gasoline boiling range can be (but need not be) present in the aviation fuel compositions, provided that the finished fuel blend has the combination of lean value octane quality and heat of combustion content required by this invention. Thus, for example, the fuel blend may contain up to about 10 volume % of aromatic gasoline hydrocarbons, at least a major proportion of which are mononuclear aromatic hydrocarbons such as toluene, xylenes, the mesitylenes, ethyl benzene, etc. Other suitable optional gasoline hydrocarbon components that can be used in formulating the aviation fuels of this invention include isopentane, light hydrocracked gasoline fractions, and/or $C_{5-6}$ gasoline isomerate.

Preferred aviation fuel compositions of this invention are further characterized by having:

a) a copper strip corrosion as determined by ASTM Test Method D 130 of number 1, maximum;

b) a potential gum (5-hour aging gum) as determined by ASTM Test Method D 873 of 6 mg per 100 mL maximum, or a potential gum (16-hour aging gum as determined by ASTM Test Method D 873) of 10 mg per 100 mL;

c) a sulfur content as determined by ASTM Test Method D 1266 or D 2622 of 0.05% by weight maximum;

d) a freezing point as determined by ASTM Test Method D 2386 of −72° F. maximum; and e) a water reaction as determined by ASTM Test Method D 1094 wherein the volume change, if any, does not exceed ±2 mL.

Another embodiment of this invention provides the method of operating a four stroke cycle, reciprocating piston aircraft engine which comprises providing or using as the fuel for said engine a gasoline composition of this invention.

Still another embodiment of this invention provides, in combination, at least one four stroke cycle, reciprocating piston aircraft engine and at least one fuel storage tank operatively connected with said at least one engine so as to deliver fuel required to operate said engine, said at least one fuel storage tank containing a gasoline composition of this invention as the fuel for said engine.

Cyclopentadienyl manganese tricarbonyl compounds which can be used in the practice of this invention include cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tertbutylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. Preferred are the cyclopentadienyl manganese tricarbonyls which are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc. Preparation of such compounds is described in the literature, for example, U.S. Pat. No. 2,818,417, disclosure of which is incorporated herein in toto. The aviation fuels of this invention will contain an amount of one or more of the foregoing cyclopentadienyl manganese tricarbonyl compounds sufficient to provide the requisite octane number and valve seat wear performance characteristics.

In another preferred embodiment the unleaded gasoline composition additionally contains at least one antioxidant in an amount not in excess of 8.4 pounds per 1000 barrels, said antioxidant being selected from the group N,N'-diisopropyl-p-phenylenediamine, N,N'-disec-butyl-p-phenylenediamine, 2,4-dimethyl-6-tert-butylphenol, 2,6-di-tert-butyl-4-methylphenol, 2,6-ditert-butylphenol, a mixture of 75% minimum 2,6-di-tert-butylphenol plus 25% maximum di- and tri-tert-butylphenol; and a mixture of 75% minimum di- and triisopropyl phenols plus 25% maximum di- and tri-tert-butylphenol. Most preferably the amount of such antioxidant does not exceed 4.2 pounds per 1000 barrels.

It is to be understood that the fuels of this invention are unleaded in the sense that a lead-containing antiknock agent is not deliberately added to the gasoline. Trace amounts of lead due to contamination of equipment or like circumstances are permissible and are not to be deemed excluded from the practice of this invention.

Other components which can be employed, and under certain circumstances are preferably employed, include dyes which do not contribute to excessive induction system deposits. Typical dyes which can be employed are 1,4-dialkylaminoanthraquinone, p-diethylaminoazobenzene (Color Index No. 11020) or Color Index Solvent Yellow No. 107, methyl derivatives of azobenzene-4-azo-2-naphthol (methyl derivatives of Color Index No. 26105), alkyl derivatives of azobenzene-4-azo-2-naphthol, or equivalent materials. The amounts used should, wherever possible, conform to the limits specified in ASTM Specification D 910-90.

Fuel system icing inhibitors may also be included in the fuels of this invention. Preferred are ethylene glycol monomethyl ether and isopropyl alcohol, although materials giving equivalent performance may be considered acceptable for use. Amounts used should, wherever possible, conform to the limits referred to in ASTM Specification D 910-90.

In accordance with other preferred embodiments this invention further provides:

A) The method of operating a four stroke cycle, reciprocating piston aircraft engine which comprises operating said engine on, providing to said engine, and/or using in said engine, a gasoline composition of this invention; and B) Apparatus which comprises in combination (i) at least one four stroke cycle, reciprocating piston aircraft engine, and (ii) at least one fuel storage tank operatively connected with said at least one engine so as to deliver fuel required to operate said engine, said at least one fuel storage tank containing a gasoline composition of this invention as the fuel for said engine.

Aviation engine lubricating oils meeting the requirements necessary for such usage are available as articles of commerce from a number of well known suppliers of formulated lubricating oil compositions. A few commercially available aviation lubricating oils suitable for use in accordance with various manufacturers' specifications include Mobil AV 1 20W-50 aviation oil available from Mobil Oil Company; Phillips 66 X/C 20W-50 aviation oil available from Phillips Petroleum Company; and a line of aviation oils sold under the Aeroshell trademark of Shell Oil Company such as Aeroshell 15W-50 multigrade aviation oil, Aeroshell W100 SAE 50 aviation oil and Aeroshell W80 aviation oil.

Alkyl ethers, such as methyl tertiary butyl ether (MTBE), ethyl tertiary butyl ether (ETBE), tertiary amyl methyl ether (TAME), etc., which can be used as blending agents in motor gasolines in order to improve octane quality possess a substantial drawback when used in conventional unleaded aviation base fuel. This results from the fact that if used in amounts such as 15 volume % in an aviation base fuel (the amount required to achieve a substantial increase in octane quality in the absence of an antiknock agent), the heat content of the resultant fuel is reduced to such an extent that it is not only below the ASTM standards for 100/130 grade aviation gasoline, but less than 18,000 BTU/lb as well. This in turn means that the use of the ether at these levels substantially reduces the range of the aircraft, which obviously is a most undesirable result.

Despite the foregoing shortcoming of the ether blending components, a feature of this invention is the excellent cooperation which exists among the ether, the aviation alkylate and the cyclopentadienyl manganese tricarbonyl compound used as essential ingredients in producing the aviation fuel. Pursuant to this invention, amounts of such alkyl ethers of up to about 10 volume % are used in the aviation fuel composition without fear of diminishing the range of the resultant aviation fuel, this result being due to the copresence in the fuel composition of the cyclopentadienyl manganese tricarbonyl compound and the aviation alkylate. In other words, the alkyl ether, the aviation alkylate and the cyclopentadienyl manganese tricarbonyl work together at concentrations of 5–10 volume % of the ether in the aviation fuel to provide a finished aviation fuel which possesses the heat content necessary to satisfy the 18,000 BTU/lb level required pursuant to this invention.

Presented in Table I are the heat contents and octane qualities of typical individual blending components such as are utilized in forming the finished fuels of this invention. In each case, the properties shown for the individual blending component are those possessed by the component when utilized in the absence of any other component or additive.

TABLE I

| Fuel Component | Heat Content, Net btu/lb | Motor Octane Number |
|---|---|---|
| Aviation Alkylate | 19,100 | 92 |
| Toluene | 17,420 | 93 |
| MTBE | 15,100 | 100 |
| ETBE | 15,500 | 102 |
| TAME | 15,700 | 98 |

In particular, the data in Table I show that the only component thereof having the requisite heat content to satisfy requirements of ASTM D 910 is the aviation alkylate. On the other hand, its octane quality is insufficient. The three ether blending agents have good octane qualities, but poor heat contents. The toluene, which exemplifies aromatic gasoline components, has a poorer heat content than the aviation alkylate, although it is still better than the heat contents of the ethers, and the octane quality of the toluene is not substantially better than that of the aviation alkylate.

When preparing the multicomponent blends of this invention, it is important to employ the components in the proper proportions in order to achieve the requisite properties such as described above. This is illustrated by the data in Table II which show the octane qualities and heat contents of three different fuel blends not of this invention. Fuel X is a blend of 50 volume % of a commercially-available aviation alkylate gasoline, 30 volume % of MTBE, and 20 volume % of toluene. Fuel Y is composed of the same components in the respective volume % proportions of 60, 30, and 10 %. In Fuel Z, the same three components are in the proportions of 75, 15, and 10 volume %, respectively. Table II also presents the specification values set forth in the latest version of ASTM D 910. Each fuel blend contains 0.3 grams of manganese per gallon as methyl cyclopentadienyl manganese tricarbonyl.

TABLE II

| Fuel | Lean Octane Number Rating | Supercharge Performance Number | Heat Content, Net btu/lb |
|---|---|---|---|
| X | 99.3 | 159.1 | 17,564 |
| Y | 101.7 | 142.5 | 17,732 |
| Z | 98.9 | 127.8 | 18,332 |
| Specification | 100.0 | 130.0 | 18,720 |

It will be seen from Table II that none of the fuels achieves the desired combination of properties at the level of methyl cyclopentadienyl manganese tricarbonyl used.

The following Comparative Examples set forth laboratory test data which further illustrate the difficulties that were encountered in seeking to achieve the objectives of this invention using combinations of the aviation alkylate, the ether, and the cyclopentadienyl manganese tricarbonyl, with or without auxiliary gasoline hydrocarbons. In these Comparative Examples all percentages are by volume.

Comparative Example A

Blends are formed from 85% Chevron aviation alkylate from the Pascagoula, Mississippi refinery having a heat content of approximately 19,100 btu/lb, 5% of MTBE, 10% toluene, and methylcyclopentadienyl manganese tricarbonyl (MCMT) in amounts equivalent to 0.3, 0.4, and 0.5 grams of manganese per gallon. The actual heat content of the fuels (ASTM D 2382) was found to be 18,700 BTU/lb. The lean rating octane numbers were 96.3, 97.1 and 97.9 at the three respective manganese levels.

Comparative Example B

Blend are formed from 92% of the same Chevron aviation alkylate as used in Comparative Example A, 8% of MTBE and methylcyclopentadienyl manganese tricarbonyl (MCMT) in amounts equivalent to 0.3, 0.4, and 0.5 grams of manganese per gallon. The actual heat content of the fuels (ASTM D 2382) was found to be 18,763 BTU/lb. The lean rating octane numbers were 96.7, 97.8 and 99.2 at the three respective manganese levels.

Comparative Example C

Blends are formed from 90% of the same Chevron aviation alkylate as in Comparative Example A, 5% of MTBE, 5% toluene, and methylcyclopentadienyl manganese tricarbonyl (MCMT) in amounts equivalent to 0.3, 0.4, and 0.5 grams of manganese per gallon. The actual heat content of the fuels (ASTM D 2382) was found to be 18,781

BTU/lb. The lean rating octane numbers were 96.2, 97.7 and 98.6 at the three respective manganese levels.

Comparative Example D

Blends are formed from 90% of the same Chevron aviation alkylate as in Comparative Example A, 10% of MTBE, and MCMT in amounts equivalent to 0.3, 0.4, and 0.5 grams of manganese per gallon. The actual heat content of the fuels (ASTM D 2382) was found to be 18,702 BTU/lb. The lean rating octane numbers were 97.3, 98.2 and 99.1 at the three respective manganese levels.

The test results of Comparative Examples A-D above indicate that although the heats of combustion were satisfactory, more than 0.6 gram of manganese per gallon as MCMT would be necessary to achieve the 100 lean rating octane number in the fuel blends therein described.

Comparative Example E

A blend is formed from 90% of Chevron aviation alkylate from the Pascagoula, Mississippi refinery produced from an isobutene-depleted butene feedstock to the alkylation unit, 10% of MTBE, and MCMT in amount equivalent to 0.3 gram of manganese per gallon. The actual heat content of the fuel (ASTM D 2382) was found to be 18,671 BTU/lb. The lean rating octane number of this fuel was 99.6.

The heat of combustion of the fuel of Comparative Example E was satisfactory, albeit slightly below the ASTM Specification 910-90 minimum value of 18,700 BTU/lb. In fact, on the basis of the test work reported herein, slight adjustment in the makeup of the base fuel of used in that fuel composition (e.g., use of a slightly higher amount of the alkylate and slightly less MTBE, or alternatively, replacement of the MTBE by ETBE) would enable its heat of combustion to be raised to reach this specification level. Likewise the lean rating octane number of the fuel of Comparative Example E was close to the target value of 100. As will be seen from Example 1 hereinafter, the presence of slightly more than 0.4 gram of manganese per gallon as MCMT enables this particular fuel to reach the target 100 octane value.

Comparative Example F

Blends are formed from 85% of the same Chevron aviation alkylate as used in Comparative Example E, 5% of MTBE, and MCMT in amounts equivalent to 0.3, 0.4 and 0.5 grams of manganese per gallon. The actual heat content of the fuels (ASTM D 2382) was found to be 18,724 BTU/lb. The lean rating octane numbers were 98.1, 99.1 and 99.7 at the three respective manganese levels.

From Comparative Example F it is seen that the heat of combustion achieved the target value, and that the inclusion in this fuel of suitable amounts of MCMT in the range of above 0.5 and up to 0.6 gram manganese per gallon would provide the target 100 lean rating octane number.

EXAMPLE 1

Blends are formed from 90% of the same Chevron aviation alkylate as used in Comparative Example E, 10% of MTBE, and MCMT in amounts equivalent to 0.4 and 0.5 grams of manganese per gallon. The actual heat content of the fuels (ASTM D 2382) was found to be 18,671 BTU/lb. The lean rating octane numbers were 99.8 and 101.6 at the respective manganese levels. The base fuel blend without the MCMT had a lean rating octane number of 95.9.

EXAMPLE 2

Blends are formed from 92% of the same Chevron aviation alkylate as used in Comparative Example E, 8% of MTBE, and MCMT in amounts equivalent to 0.4 and 0.5 grams of manganese per gallon. The actual heat content of the fuels (ASTM D 2382) was found to be 18,767 BTU/lb. The lean rating octane numbers were 100.9 and 104.0 at the respective manganese levels. The base fuel blend without the MCMT had a lean rating octane number of 95.0.

EXAMPLE 3

Blends are formed from 90% of the same Chevron aviation alkylate as used in Comparative Example E, 5% of MTBE, 5% of toluene, and MCMT in amounts equivalent to 0.4 and 0.5 grams of manganese per gallon. The actual heat content of the fuels (ASTM D 2382) was found to be 18,823 BTU/lb. The lean rating octane numbers were 99.9 and 101.6 at the respective manganese levels. The base fuel blend without the MCMT had a lean rating octane number of 94.3.

EXAMPLE 4

The gasoline compositions of Examples 1–3 were additionally subjected to supercharge ratings in accordance with ASTM Test Method D 909. The supercharge performance numbers (SPN) of these fuels reported to the nearest whole number are set forth in Table III.

TABLE III

| Fuel Composition | Grams Mn per Gallon | SPN |
|---|---|---|
| Example 1 | 0.4 | 131 |
| Example 1 | 0.5 | 145 |
| Example 2 | 0.4 | 140 |
| Example 2 | 0.5 | 140 |
| Example 3 | 0.4 | 143 |
| Example 3 | 0.5 | 142 |

It can be seen from the foregoing that in one of its preferred forms this invention provides an unleaded aviation gasoline composition which comprises a blend of from 85 to 92% by volume of aviation alkylate gasoline, from 4 to about 10% by volume of a gasoline-soluble dialkyl ether gasoline blending agent, from about 0.25 to about 0.6 grams of manganese per gallon as at least one cyclopentadienyl manganese tricarbonyl compound, and optionally up to about 10% by volume of other gasoline hydrocarbons with the proviso that said gasoline composition possesses at least the octane qualities and heat contents called for by ASTM Specification D 910-90.

Other suitable fuel compositions of this invention will now be readily apparent to those skilled in the art from a consideration of the foregoing disclosure.

This invention is susceptible to considerable variation. Thus it is not intended that this invention be limited by the specific exemplifications set forth hereinabove. Rather what is intended to be covered is the subject matter within the spirit and scope of the ensuing claims.

What is claimed is:

1. An unleaded aviation gasoline composition which comprises:

(a) from 85 to 92 volume percent of aviation alkylate;

(b) from 4 to 10 volume percent of at least one ether selected from methyl tertiary-butyl ether, ethyl tertiary-butyl ether, methyl tertiary-amyl ether, and mixtures of any two or all three of the foregoing ethers;

(c) from zero to 10 volume percent of one or more other hydrocarbons falling in the aviation gasoline boiling range; and (d) from 0.25 to 0.6 gram of manganese per gallon as one or more cyclopentadienyl manganese tricarbonyl compounds;

wherein the sum of the amounts of (a) and (b), and also of (c) if present, is 100 volume percent; with the proviso that (a), (b) and (d), and also (c) if present, are proportioned such that said composition has (i) an ASTM D 2382 heat of combustion of at least 18,000 BTU per pound, and (ii) a minimum knock value lean rating octane number of 100 as determined by ASTM Test Method D 2700 and wherein motor method octane ratings are converted to aviation ratings in the manner described in ASTM Specification D 910-90.

2. A composition as claimed in claim 1 wherein said gasoline composition has a minimum performance number reported to the nearest whole number and as determined by ASTM Test Method D 909 of 130.

3. A composition as claimed in claim 1 wherein said aviation alkylate is formed by acid-catalyzed isoparaffin-olefin alkylation wherein the butene fraction of a mixed olefin feedstock is an isobutene depleted mixed olefin feedstock.

4. A composition as claimed in claim 1 wherein said ether is methyl tertiary-butyl ether.

5. A composition as claimed in claim 1 wherein said cyclopentadienyl manganese tricarbonyl compound consists essentially of methylcyclopentadienyl manganese tricarbonyl.

6. A composition as claimed in claim 1 wherein said aviation alkylate is formed by acid-catalyzed isoparaffin-olefin alkylation wherein the butene fraction of a mixed olefin feedstock is an isobutene depleted mixed olefin feedstock; wherein said ether is methyl tertiary-butyl ether, and wherein said cyclopentadienyl manganese tricarbonyl compound consists essentially of methylcyclopentadienyl manganese tricarbonyl.

7. A composition as claimed in claim 1 wherein said gasoline composition has a heat of combustion of at least 18,700 BTU per pound.

8. A composition as claimed in claim 7 wherein said aviation alkylate is formed by acid-catalyzed isoparaffin-olefin alkylation wherein the butene fraction of a mixed olefin feedstock is an isobutene depleted mixed olefin feedstock; wherein said ether is methyl tertiary-butyl ether, and wherein said cyclopentadienyl manganese tricarbonyl compound consists essentially of methylcyclopentadienyl manganese tricarbonyl.

9. A composition as claimed in claim 7 wherein said gasoline composition has a minimum performance number reported to the nearest whole number and as determined by ASTM Test Method D 909 of 130.

10. A composition as claimed in claim 7 wherein said aviation alkylate is formed by acid-catalyzed isoparaffin-olefin alkylation wherein the butene fraction of a mixed olefin feedstock is an isobutene depleted mixed olefin feedstock, and wherein said ether consists essentially of methyl tertiary-butyl ether.

11. A composition as claimed in claim 10 wherein said gasoline composition has a minimum performance number reported to the nearest whole number and as determined by ASTM Test Method D 909 of 130.

12. A composition as claimed in claim 1 wherein said aviation alkylate is formed by acid-catalyzed isoparaffin-olefin alkylation wherein the butene fraction of a mixed olefin feedstock is an isobutene depleted mixed olefin feedstock, and wherein said ether consists essentially of methyl tertiary-butyl ether.

13. A composition as claimed in claim 12 wherein said gasoline composition has a minimum performance number reported to the nearest whole number and as determined by ASTM Test Method D 909 of 130.

14. A composition as claimed in claim 13 wherein said cyclopentadienyl manganese tricarbonyl compound consists essentially of methylcyclopentadienyl manganese tricarbonyl.

15. The method of operating a four stroke cycle, reciprocating piston aircraft engine wherein the fuel used in operating said engine is an unleaded aviation gasoline composition which comprises:

(a) from 85 to 92 volume percent of aviation alkylate;

(b) from 4 to 10 volume percent of at least one ether selected from methyl tertiary-butyl ether, ethyl tertiary-butyl ether, methyl tertiary-amyl ether, and mixtures of any two or all three of the foregoing ethers;

(c) from zero to 10 volume percent of one or more other hydrocarbons falling in the aviation gasoline boiling range; and (d) from 0.25 to 0.6 gram of manganese per gallon as one or more cyclopentadienyl manganese tricarbonyl compounds;

wherein the sum of the amounts of (a) and (b), and also of (c) if present, is 100 volume percent; with the proviso that (a), (b) and (d), and also (c) if present, are proportioned such that said composition has (i) an ASTM D 2382 heat of combustion of at least 18,000 BTU per pound, and (ii) a minimum knock value lean rating octane number of 100 as determined by ASTM Test Method D 2700 and wherein motor method octane ratings are converted to aviation ratings in the manner described in ASTM Specification D 910-90.

16. A method as claimed in claim 15 wherein said gasoline composition has a heat of combustion of at least 18,700 BTU per pound, and a minimum performance number reported to the nearest whole number and as determined by ASTM Test Method D 909 of 130.

17. A method as claimed in claim 15 wherein said aviation alkylate is formed by acid-catalyzed isoparaffin-olefin alkylation wherein the butene fraction of a mixed olefin feedstock is an isobutene depleted mixed olefin feedstock; wherein said ether is methyl tertiary-butyl ether, and wherein said cyclopentadienyl manganese tricarbonyl compound consists essentially of methylcyclopentadienyl manganese tricarbonyl.

18. A method as claimed in claim 15 wherein said aviation alkylate is formed by acid-catalyzed isoparaffin-olefin alkylation wherein the butene fraction of a mixed olefin feedstock is an isobutene depleted mixed olefin feedstock, wherein said ether consists essentially of methyl tertiary-butyl ether and wherein said gasoline composition has a heat of combustion of at least 18,700 BTU per pound.

19. A method as claimed in claim 18 wherein said cyclopentadienyl manganese tricarbonyl compound consists essentially of methylcyclopentadienyl manganese tricarbonyl.

* * * * *